United States Patent [19]

Koss

[11] 4,087,220

[45] May 2, 1978

[54] APPARATUS FOR BUILDING A CONCRETE BRIDGE SUPERSTRUCTURE

[76] Inventor: Kurt Koss, Sebastianplatz 7, 1030 Vienna, Austria

[21] Appl. No.: 728,767

[22] Filed: Oct. 1, 1976

Related U.S. Application Data

[63] Continuation of Ser. No. 556,175, Mar. 6, 1975, abandoned.

[30] Foreign Application Priority Data

Mar. 12, 1975 Austria ..... 2067/75

[51] Int. Cl.[2] ..... E01D 1/00

[52] U.S. Cl. ..... 425/63; 14/1; 249/20; 264/33

[58] Field of Search ..... 425/62–65; 249/20–21; 264/33, 34; 14/1

[56] References Cited

U.S. PATENT DOCUMENTS

| | | | |
|---|---|---|---|
| 3,003,219 | 10/1961 | Suter et al. | 264/33 |
| 3,299,191 | 1/1967 | Mantscheff et al. | 264/34 |
| 3,490,605 | 1/1970 | Koss | 14/1 |
| 3,571,835 | 3/1971 | Buechler | 425/63 |
| 3,579,759 | 5/1971 | Zuccolo | 425/62 |
| 3,985,480 | 10/1976 | Finsterwalder | 425/63 |

*Primary Examiner*—Francis S. Husar

*Assistant Examiner*—John McQuade

*Attorney, Agent, or Firm*—Kurt Kelman

[57] ABSTRACT

An apparatus for the sequential production of concrete sections of a superstructure spanning a plurality of piers comprises a main girder positioned above a respective one of the piers and advanceable from pier to pier. A concrete form is carried by the girder for producing portions of each superstructure section, the concrete forms being movable along the girder. The main girder is supported on previously completed portions of the superstructure and can be advanced thereon by means of an auxiliary support in the center of the girder, two main supports positionable rearwardly of the auxiliary support and a third main support positionable forwardly of the auxiliary support. The main supports are in thrust and stress force bearing connection with the main girder and the main supports are movable along the girder in the longitudinal direction. The main supports may be retracted and lowered for vertically moving the main girder together with the concrete form carried thereby and any concrete therein. A portion above a pier is produced by mounting a support structure on the front main support after the same has been aligned with the pier, connecting the support structure to the pier so that the girder is supported on the three main supports and then forming the portion in the concrete form.

7 Claims, 33 Drawing Figures

APPARATUS FOR BUILDING A CONCRETE BRIDGE SUPERSTRUCTURE

This is a continuation of application Ser. No. 556,175, filed Mar. 6, 1975, now abandoned.

The present invention relates to improvements in apparatus for the sequential production of concrete sections of a superstructure spanning a plurality of piers spaced from each other in a longitudinal direction and supporting the superstructure sections to build cantilever bridges and like support structures.

Austrian Pat. No. 273,212 discloses a bridge building method for producing portions of the superstructure by means of a carrier frame or scaffolding which is supported on a previously completed superstructure portion or pier and on the piers adjacent thereto, and the superstructure portions are produced sequentially and simultaneously advancing from the center pier towards the adjacent piers. This method has some serious disadvantages. Thus, before the carrier frame can be advanced after the last portion of the superstructure section spanning the three piers has been completed, the center portion on the next succeeding pier supporting the subsequent superstructure section to be built must be produced in a concrete form which cannot be carried by the carrier frame since this portion is needed for the support of the carrier frame. Furthermore, the sequential portions on each side of the center pier must be produced simultaneously so that two sets of concrete pouring equipment and crews are needed, thus doubling the expenses. The entire procedure is complex and costly, and difficult to use in curves.

Austrian Pat. No. 279,666 proposes a carrier frame for building portions of a bridge superstructure ridigly supported on piers, wherein the carrier frame may be moved in the direction of the bridge and is supported in an operative position on one of the piers or a superstructure portion supported on the pier while the frame has cantilever portions freely extended in the direction of the bridge from the pier. The cantilever portions of the carrier frame are supported on blocks placed on previously completed portions of the superstructure extending in cantilever fashion from the pier. The carrier frame is centrally supported by roller or gliding blocks which permit the frame to be moved thereon in the direction of the bridge, and the support blocks may be vertically adjusted to balance the elastic deformation of the carrier frame.

This method does not permit the production of sections of a bridge superstructure supported on roller or pivotal bearings. Also, the building of curved sections is very difficult with such an arrangement. The concrete forms require their own lifting mechanisms enabling the forms to be raised and lowered even when filled with concrete. The advancement of the carrier frame is quite complex and the portions of the superstructure section on each side of the pier must be produced simultaneously.

My U.S. Pat. No. 3,490,605 discloses a scaffolding which may be longitudinally moved on roller blocks. The roller blocks are suspended from the main girder of the scaffolding and are movable in a longitudinal direction. They also permit transverse movement of the main girder. However, the disclosed scaffolding can be used only for producing an entire section of the superstructure and not the sequential production of portions of such a section.

It is the primary object of this invention to provide an apparatus of the above-described type which is universally useful in the production of concrete sections of a superstructure spanning a plurality of piers, where the sections are rigidly connected to the piers or supported thereon by means of roller or pivotal bearings.

It is another object of the invention to provide such an apparatus which is simple and may be operated by a relatively small crew, and which does not require extensive concrete pouring equipment.

It is yet another object to enable the superstructure section portions on each side of a pier to be produced either simultaneously or alternatingly.

The above and other objects are accomplished in accordance with the present invention with an apparatus which comprises an elongate main girder extending in the longitudinal direction and positionable above a respective ones of the piers and the superstructure section to be supported on the pier. A concrete form is carried by the main girder for producing portions of each superstructure section, the concrete form being movable along the girder in the longitudinal direction. Support means for the girder are arranged to support the girder on previously completed portions of the superstructure and to enable the supported main girder to be moved on the support means in the longitudinal direction. The support means comprises an auxiliary support substantially in the center of the main girder intermediate a front and rear end thereof, two main supports positionable rearwardly of the auxiliary support, and a third main support positionable frontward of the auxiliary support. The main supports are in thrust and stress force bearing connection with the main girder and the supports are movable along the girder in the longitudinal direction. Means for retracting and for lowering the main supports vertically moves the main girder together with the concrete form carried thereby and any concrete therein.

The main girder is positioned above the pier, the concrete form is moved along the girder until it is positioned in the region of the pier, the main girder is supported on the two rear main supports on previously completed portions of the superstructure after the two main supports have been moved along the girder to the completed portions, the front main support is moved along the girder into alignment with the pier, a support structure is mounted on the front main support in thrust and stress force bearing connection with the front main support, the support structure is connected to the pier, and the portion of the concrete section is formed in the concrete form.

The above and other objects, advantages and features of the invention will become more apparent from the following detailed description of certain now preferred embodiments thereof, taken in conjunction with the accompanying drawing wherein FIGS. 1 to 4 are schematic side views illustrating the production of a section of the superstructure by means of the apparatus of this invention;

FIGS. 5 to 21 are like views showing the advancement of the apparatus into a sequential operating position;

Figure 1:
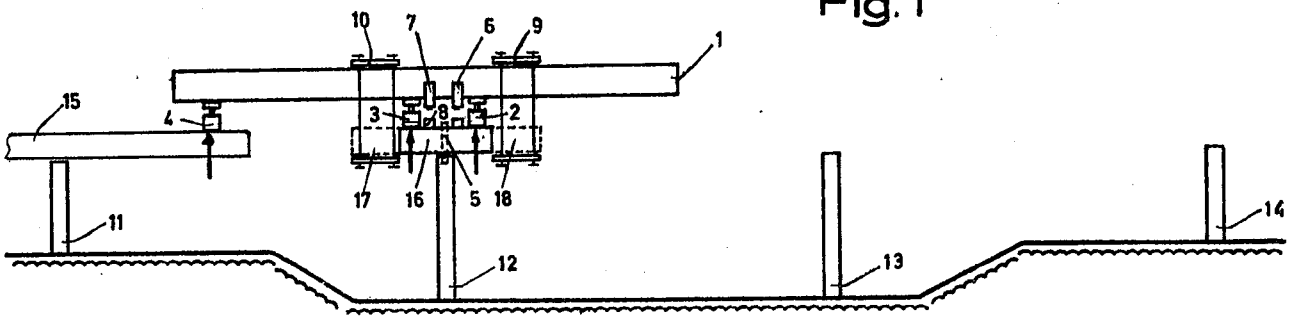

Referring now to the drawing, FIGS. 1 to 21 illustrate the sequential building of contiguous sections of a bridge superstructure according to the present invention.

As shown in FIG. 1, the bridge superstructure is to be built on piers 11, 12, 13, 14, the figure illustrating the stage of construction wherein a first section 15 of the superstructure supported on pier 11 and a center portion 16 of a contiguous superstructure section supported on pier 12 have been completed.

The illustrated apparatus for building the super structure sections comprises an elongate main girder 1 extending in the direction of the bridge and above the section to be built. The main girder carries a front concrete form or casing 9 and a rear concrete form or casing 10 for casting portions of the superstructure sections. Three main girder supports constituted by roller blocks 2, 3 and 4 are mounted on the girder in a manner enabling them to bear thrust and stress forces, and are preferably arranged to be anchored to the superstructure of the bridge. Supports 2, 3 and 4 are rotatable about a vertical axis and are movable on main girder 1 in transverse and longitudinal directions. Means, such as hydraulic cylinder-and-piston drives, are built into the girder supports for extending and retracting the same so that the main girder and the casings carried thereby may be raised and lowered. The main supports may be retracted sufficiently to enable them to remain suspended from the girder and to be freely moved therealong in the suspended condition. Pier 12 supporting center portion 16 of a superstructure to be built is substantially centered between roller blocks 2 and 3, block 2 being arranged in front and block 3 in the rear of the pier, as seen in the direction of building. Furthermore, auxiliary supports 6 and 7 are also mounted on main girder 1, with pier 12 being centered therebetween, and crossbeams 8, 8 are placed on center portion 16 in vertical alignment and for cooperation with the stabilizing supports.

In the construction stage shown in FIG. 1, main supports 2, 3 and 4 have been lowered so that rear support 4 supports the rear end of main girder 1 on completed superstructure section 15 while front and rear supports 2 and 3 support the main girder on completed center portion 16, rear and front casings 10, 9 being positioned contiguously to the respective ends of the center portion to enable contiguous portions 17 and 18 to be cast in the casings. In this position, the entire load of the girder and casings rests on roller blocks 2, 3, 4. Concrete is now poured into rear casing 10 to form superstructure section portion 17. Casing 10 may be moved into the desired position by lowering or raising the girder supports during or after the pouring of concrete. Thus, the casing requires no lifting mechanism of its own for leveling the newly poured portion of the with the previously completed, contiguous portion. After portion 17 has been completed, portion 18 is produced in the identical manner.

Figure 2:
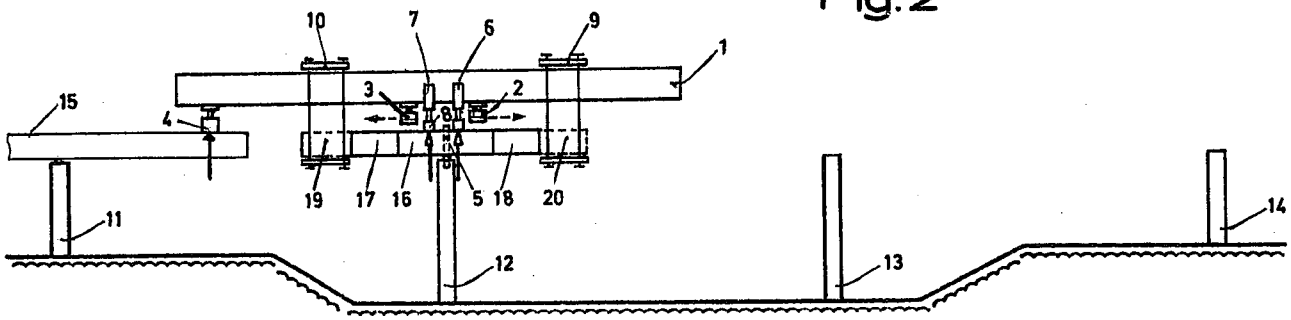
Figure 3:
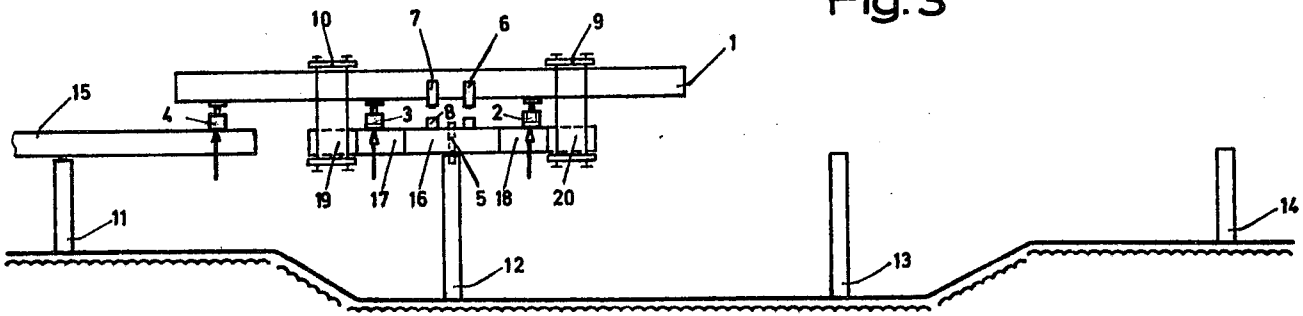

FIG. 2 shows the subsequent construction stage after superstructure portions 17 and 18 have been permitted to set. Girder supports 2, 3 and 4 are now retracted to permit main girder 1 to be lowered and to be supported on center portion 16 of the superstructure by means of auxiliary supports 6 and 7. If desired, these supports may be hydraulic jacks whose piston rods may be extended to rest on crossbeams 8. In this stage, casings 9 and 10 carry no load and the full load of the girder is carried by supports 4, 6 and 7 as indicated by the vertically upwardly pointing arrows in FIG. 2. In this load-free condition, casings 9 and 10 are moved on the girder into positions contiguous to set portions 17 and 18 of the superstructure section and ready for pouring contiguous portions 19, 20. Retracted supports 2 and 3 are similarly moved outwardly (see horizontal arrows in FIG. 2) into alignment with portions 17, 18. The moved supports 2 and 3 are now lowered again into supporting contact with portions 17, 18, causing main girder 1 to be raised into the desired position for casings 9 and 10 for pouring portions 19 and 20 (FIG. 3) in a manner anologous to the production of portions 17 and 18.

Figure 4:
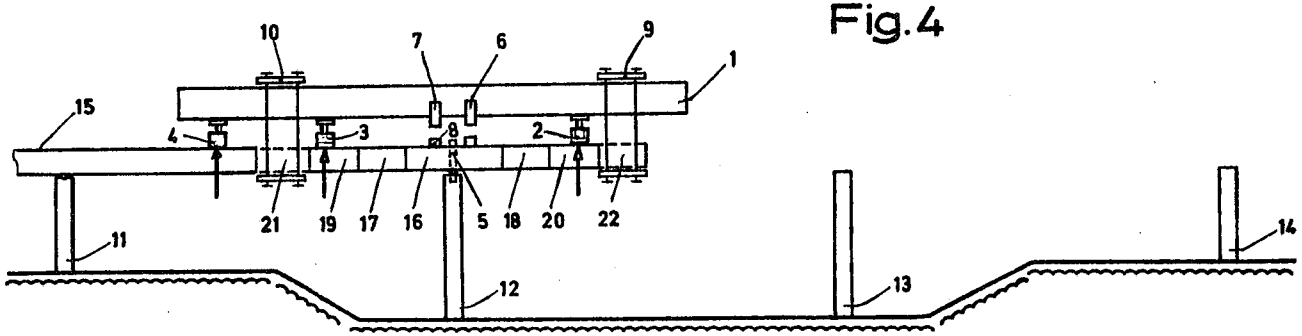

The identical procedure is repeated for the production of final portions 21 and 22 of the section of the superstructure supported on pier 12, as shown in FIG. 4, concrete being poured when the main girder is raised, girder 1 resting on auxiliary supports 6 and 7 and roller block 4 when it is lowered to relieve the casings of any load, and the front and rear supports 2 and 3 always resting on the just completed portions of the superstructure section.

Since the main girder of the apparatus always rests on three thrust and stress forces bearing main supports 2, 3 and 4 when concrete is poured, rearmost support 4 resting on previously completed superstructure section 15 while rear and front supports 3 and 2 rest on previously completed portions of a superstructure section being built, the apparatus makes it possible to produce portions of the superstructure section alternately on respective sides of the pier on which this section is supported, the pier always being centered between the alternatingly produced portions of the section. In the illustrated embodiment, the rear portion is completed first and then the front portion is completed during each construction stage. This alternating construction of portions of the superstructure section at each stage on respective sides of the pier has the advantage that it requires fewer concrete pouring devices and only half the concrete pouring crew, as compared to a symmetrical production of a pair of portions of the superstructure section on respective sides of the pier.

FIGS. 5 to 21 illustrate the movement of the main girder from its position above pier 12 to a position above next adjacent pier 13 for producing the contiguous section of the superstructure.

Figure 5:
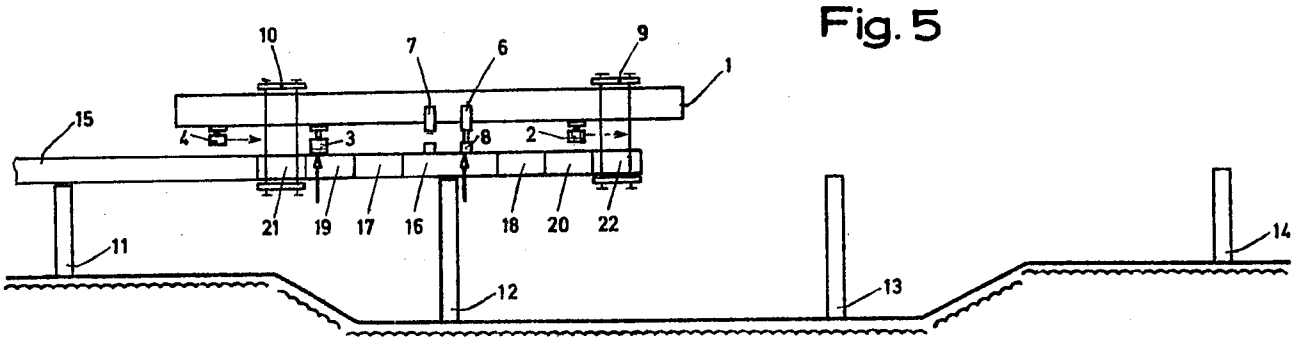
Figure 6:
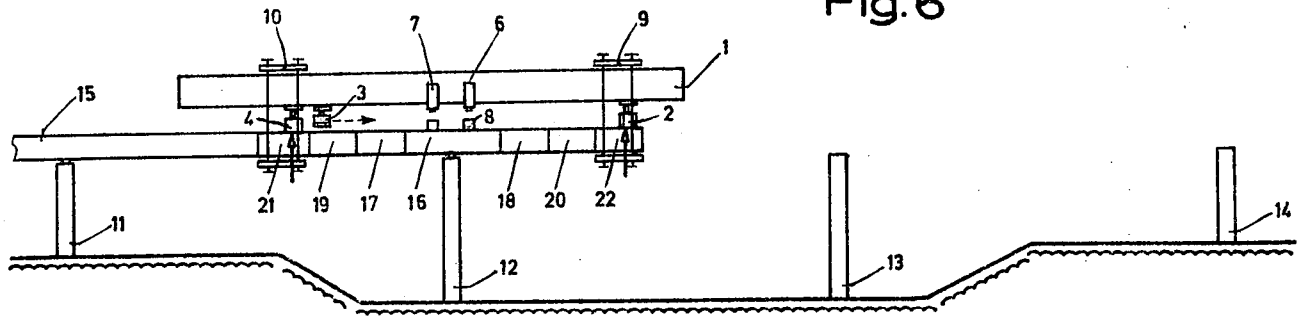

After the superstructure section supported on pier 12 has been completed, main supports 2, 3 and 4, as well as rear auxiliary support 7, are retracted while front auxiliary support 6 is lowered into contact with crossbeam 8 to support main girder 1 on the crossbeam. As shown in FIG. 5, front main support 2 and rearmost main support 4 are then further retracted so that they are freely suspended on the main girder and the entire load of the girder is carried by front auxiliary support 6 and rear main support 3. As illustrated in FIG. 6, freely suspended supports 2 and 4 are now moved forwardly on the girder into alignment with end portions 21 and 22 of the completed superstructure section and they are lowered until they support the entire weight of the girder and move rear main support 3 and front auxiliary support 6 out of contact with the superstructure section, thus enabling the freely suspended supports 3, 6 and 7 to be moved forwardly.

Figure 7:
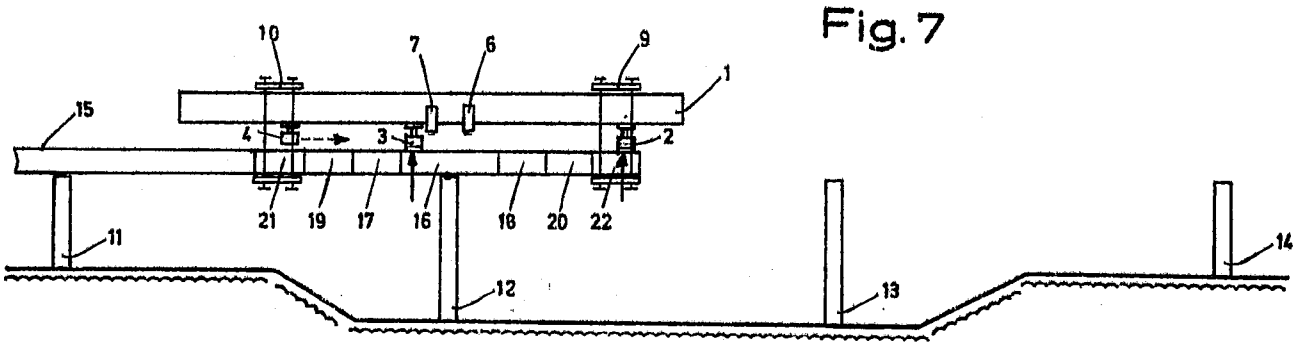
Figure 8:
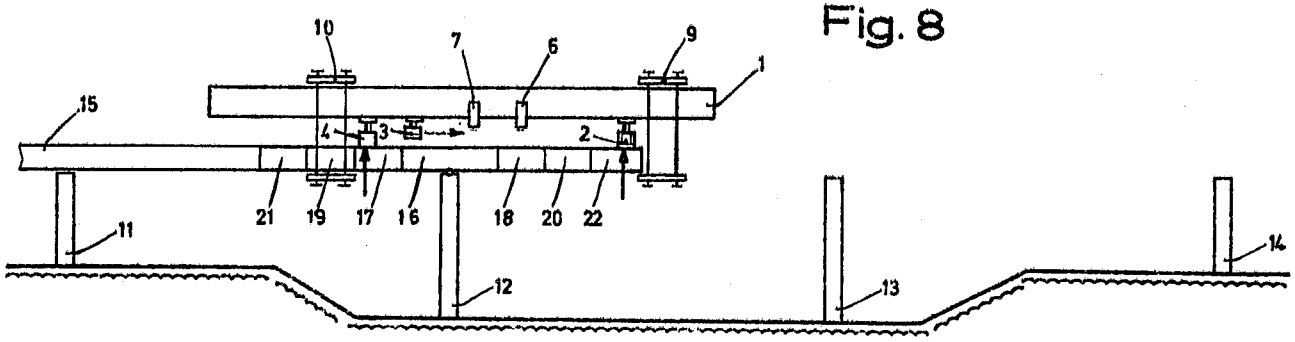
Figure 9:
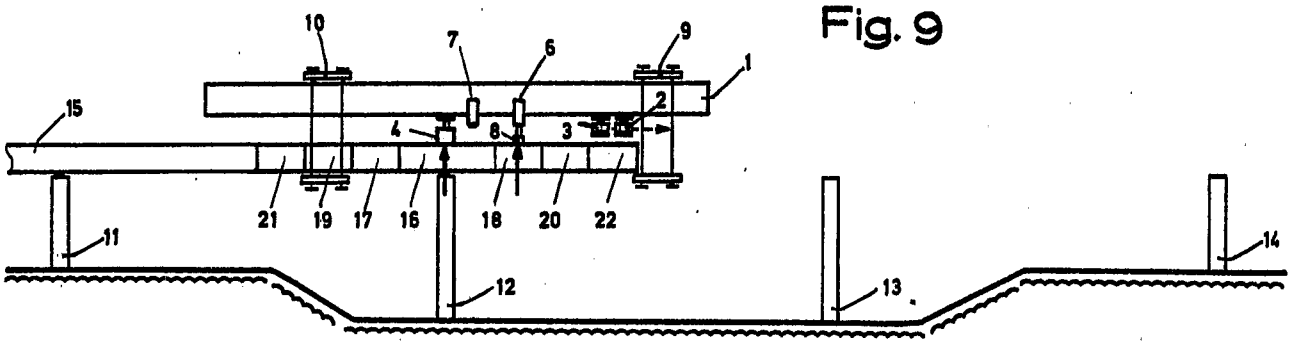
Figure 10:
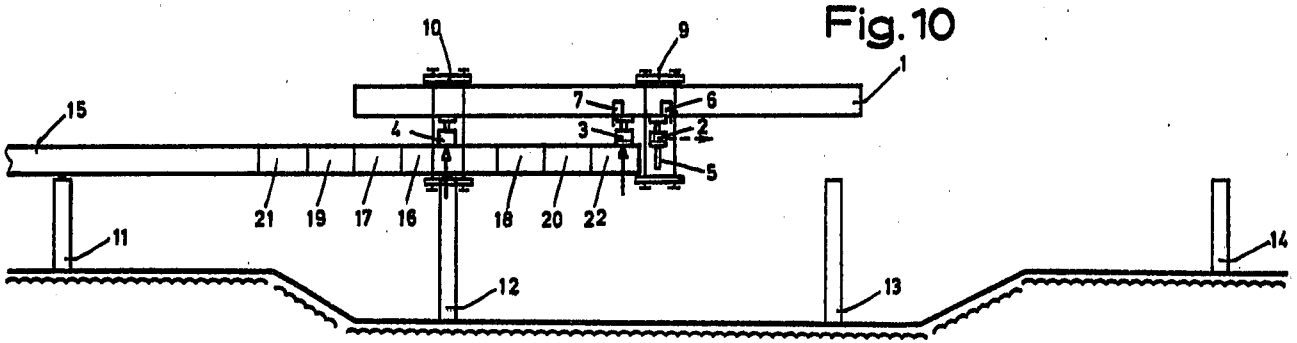

As shown in FIG. 7, the forwardly moved main support 3 is now lowered and rearmost main support 4 is retracted to support the main girder on front and rear main supports 2 and 3, enabling freely suspended support 4 to be moved forwardly next to support 3. Since main girder 1 now rests on thrust and stress forces bearing main supports 2 and 3, it may be moved forwardly on the rollers of these supports by the length of one portion of the superstructure section to be built next, as can be seen in FIG. 8. In this position, rearmost main support 4 is lowered again and rear main support 3 is retracted to shift the load from support 3 to support 4. This forward movement of the girder, with a back and forth shifting of the load between supports 3 and 4 may be repeated any desired number of times. The retracted and freely suspended rear main support 3 is eventually moved past auxiliary supports 6 and 7 next to front main support 2 and supports 3 and 4 are lowered until main girder 1 is supported on auxiliary support 6. In this position, as shown in FIG. 9, front main support 2 may be raised so that the girder is supported on auxiliary support 6 and rearmost main support 4. Retracted and freely suspended front main support 2 may now be moved forwardly and rear main support 3 may be moved into alignment with the outer edge of end portion 22 of the completed superstructure section. As shown in FIG. 10, girder 1 may now be supported and raised on main supports 3 and 4, in which position it may be advanced on the rollers of these supports until the forward end of the girder is in alignment with next adjacent pier 13.

Figure 11:
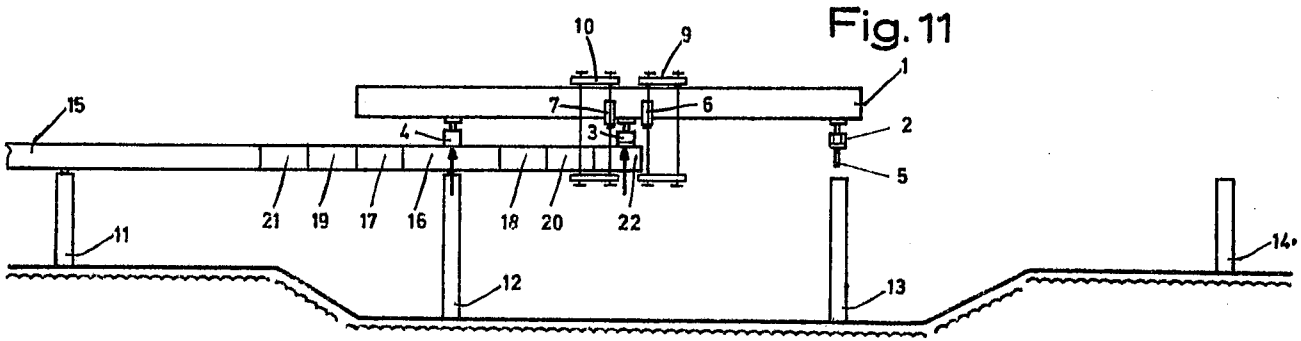

A support structure 5 consisting of two load-bearing tubes is mounted on the underside of support 2 in a manner enabling the support structure to bear thrust and stress forces. As shown in FIG. 11, front main support 2 with its support structure 5 is now moved forwardly into alignment with pier 13 so that the support structure may rest on the pier when support 2 is lowered. For this purpose, the top of the pier may define recesses receiving the tubes of the support structure, as will be more fully described hereinafter in connection with FIGS. 28 and 29.

Figure 12:
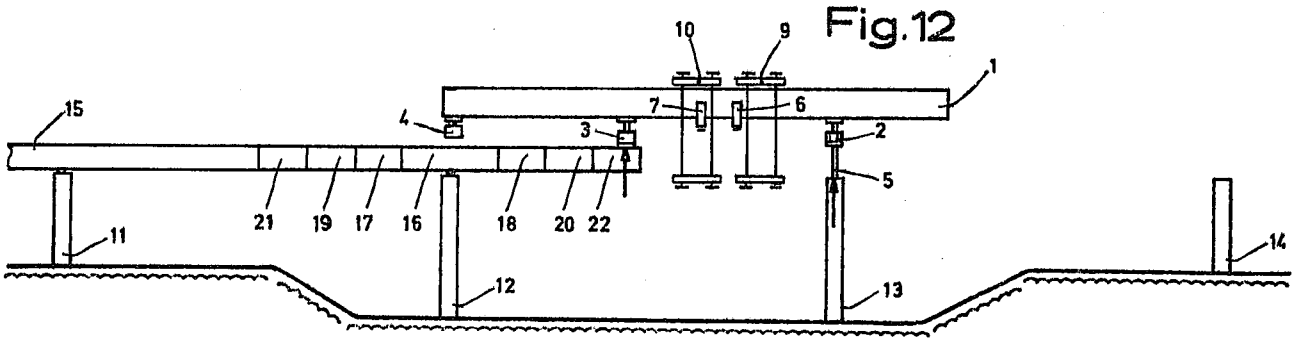
Figure 13:
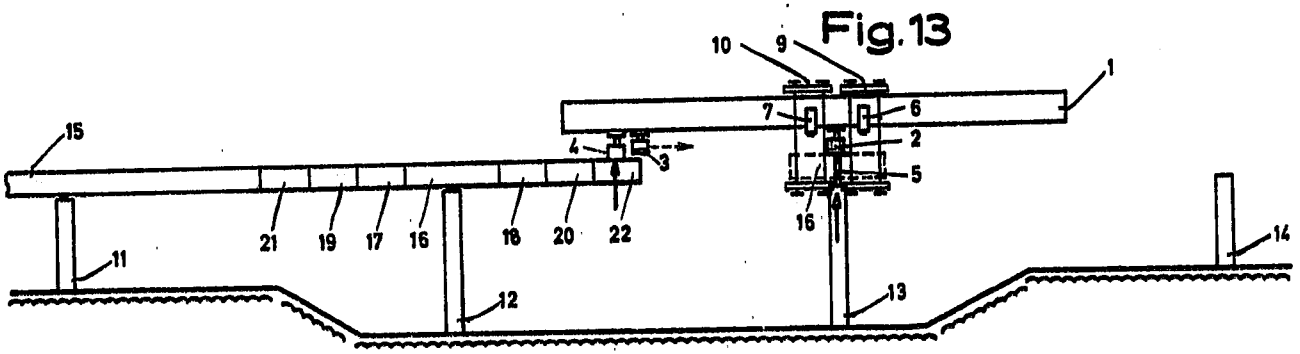
Figure 14:
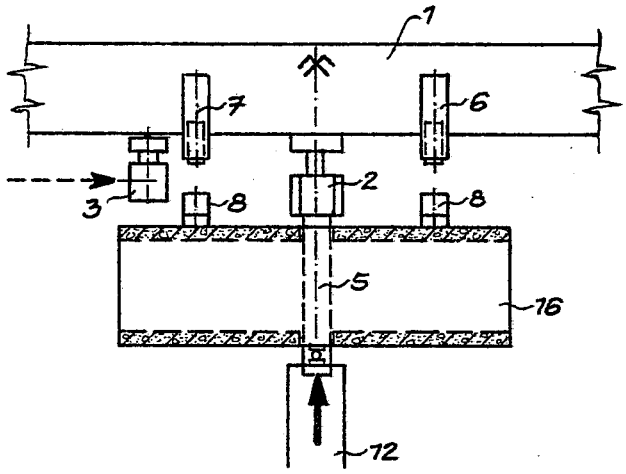

As FIG. 12 illustrates, pier 13 will now be able to support the full load of the girder, together with rear main support 3 during the further advance of the girder and while rearmost support 4 is retracted. The girder will finally be positioned above pier 13, as shown in FIG. 13, and the two concrete forms 9 and 10 will be moved on the girder into a position symmetrical in respect to the pier so as to enable center portion 16 to be poured.

This center portion may be formed in two parts, either simultaneously or in sequence. Center portion 16 may be formed into a monolith with pier 13, i.e. it may be rigidly connected with the pier to resist bending stresses, or it may be lowered on a roller or pivotal bearing support on the pier, in which case support structure 5 being built into the center portion serves as a mounting support.

Figure 15:
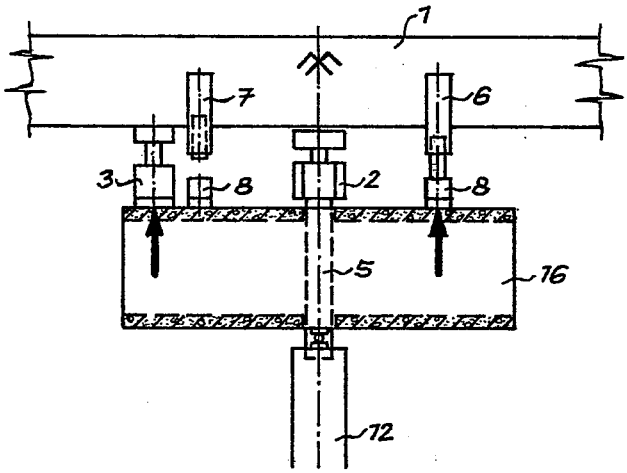
Figure 16:
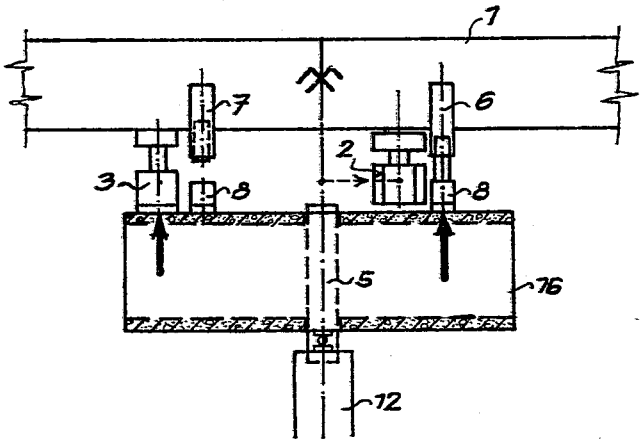
Figure 17:
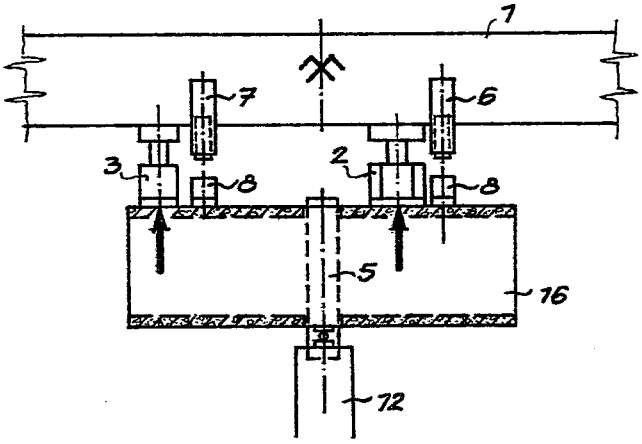
Figure 18:
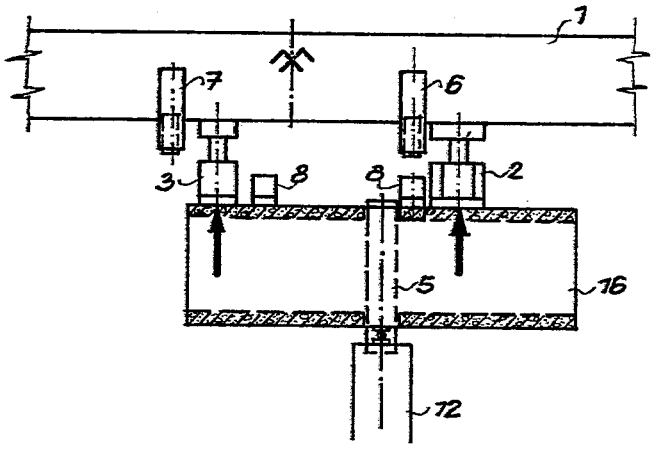
Figure 19:
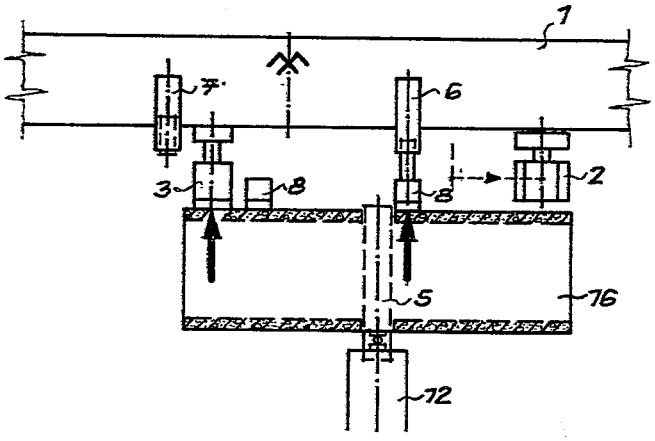
Figure 11:
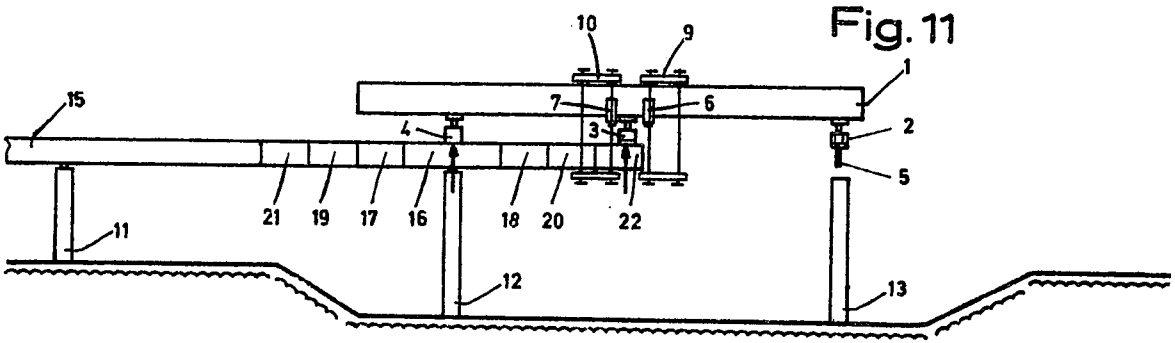
Figure 12:
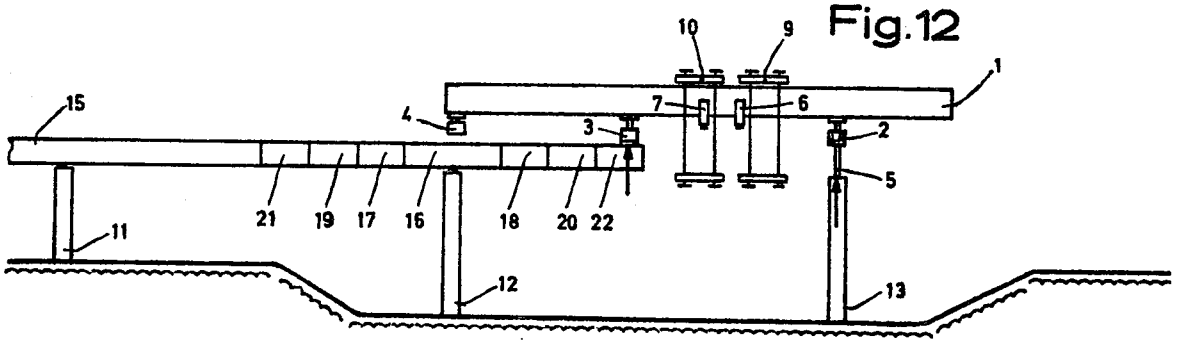

After center portion 16 has set, retracted and freely suspended rear main support 3 is moved forwardly on girder 1 (see FIGS. 13 and 14) until it is aligned with the rear end of center portion 16. At the same time, crossbeams 8, 8 are placed on the center portion symmetrically in respect of pier 13 for subsequent cooperation with symmetrically arranged auxiliary supports 6 and 7. As shown in FIG. 15, front main support 2 is now retracted so that girder 1 now rests not only on lowered rearmost main support 4 on end portion 22 of the preceding superstructure section but also on lowered rear main support 3 and lowered front auxiliary support 6. Support structure 5 is now severed from support 2 (see FIG. 16) and retracted support 2 is advanced adjacent to auxiliary support 6. Girder 1 is now raised (FIG. 17) by lowering main supports 2, 3 and 4, thus removing auxiliary support 6 from supporting contact with crossbeam 8. Girder 1 is now moved rearwardly on the rollers of supports 2, 3 and 4 into the position shown in FIG. 18 so that front auxiliary support 6 is positioned rearwardly of front main support 2. As shown in FIG. 19, auxiliary support 6 is now lowered again and main supports 2 and 3 are retracted so that girder 1 comes to be supported on auxiliary support 6. Support 2 is then further retracted and, in its freely suspended condition, it is advanced into alignment with the forward edge of center portion 16. Main supports 2 and 3 are then lowered again to raise girder 1 (see FIG. 20) and, carried by the main supports, the girder is moved forwardly into the position shown in FIG. 21 wherein the pier is centered between the supports in the same manner as shown in the initial position of FIG. 1, the auxiliary supports being in alignment with crossbeams 8, 8. The apparatus is now in position for producing alternate portions of the superstructure section support on pier 13 in the same manner as described hereinabove in connection with FIGS. 1 to 7.

Figure 22:
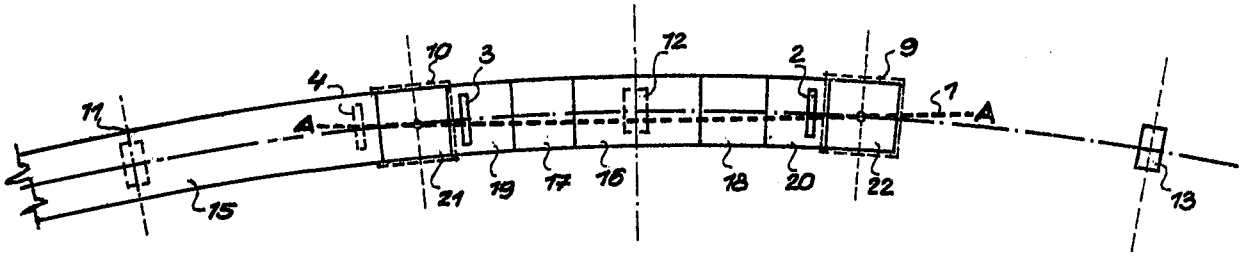
FIGS. 22 to 23 are schematic top views showing the use of the apparatus for building a curved superstructure.
Figure 23:
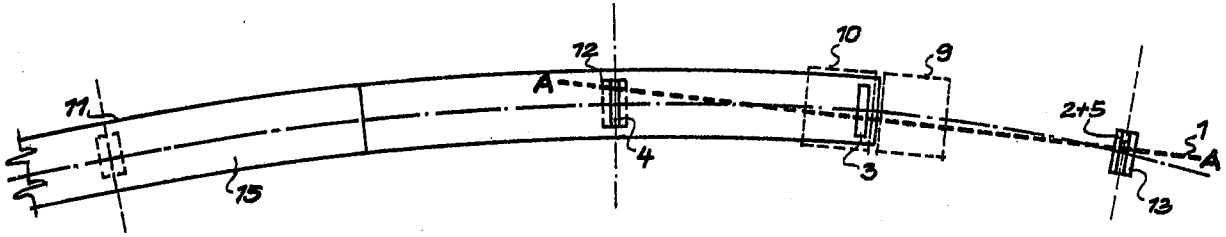
Figure 25:
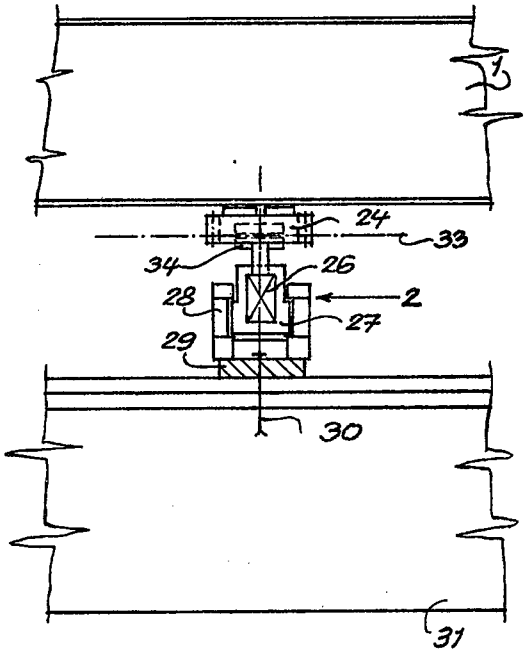
FIGS. 24 and 25 are respectively front and side elevational views of a specific embodiment of a main support used in the apparatus of the present invention.
Figure 24:
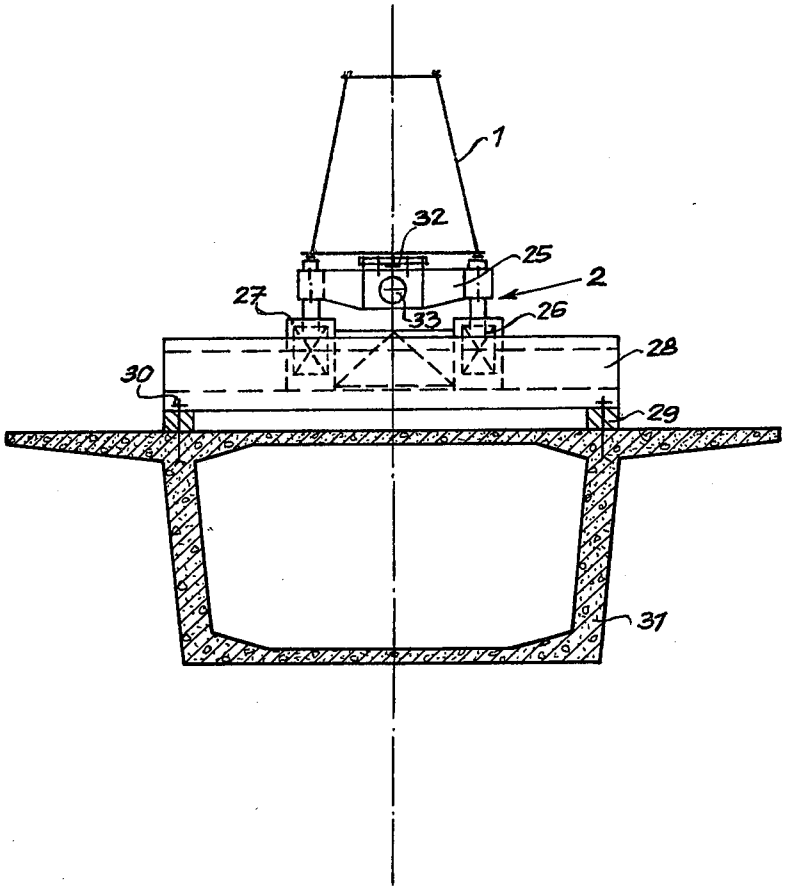
Figure 26:
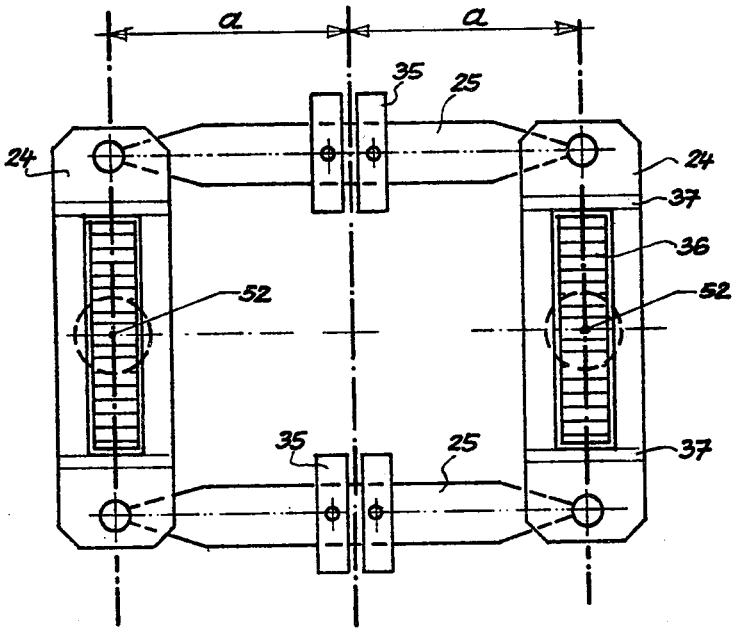
FIGS. 26 and 27 are top views illustrating more specifically the parallelogram guide system of the main support shown in FIGS. 24 and 25.
Figure 27:
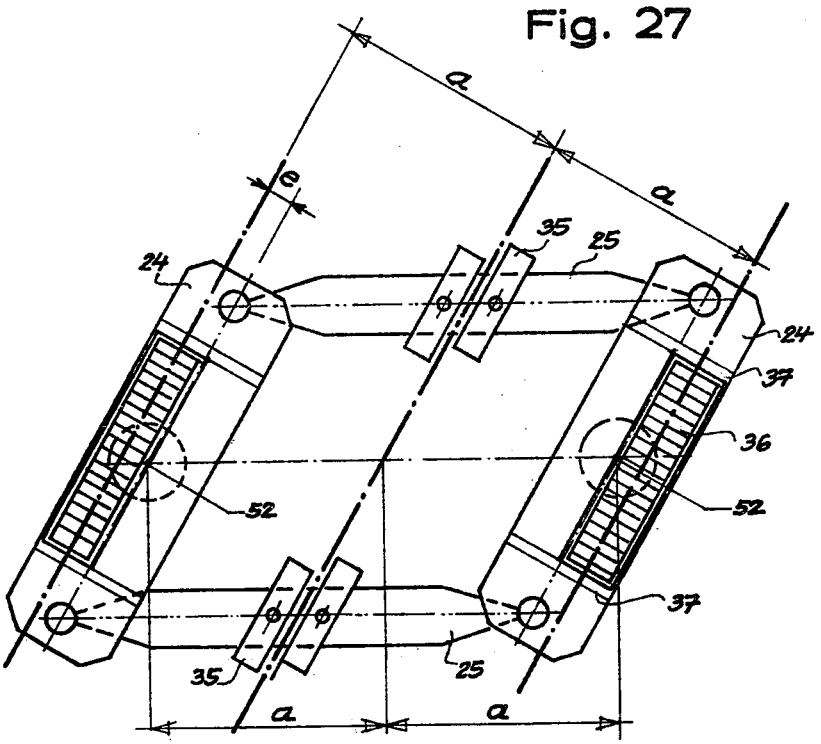

As will be seen from FIGS. 22 and 23, the above-described apparatus of the present invention may readily be used for the production of curved superstructure portions without the need for dismounting concrete forms 9 and 10 during advancement of main girder 1. FIG. 22 shows a position of the main girder corresponding to that of FIG. 4, in top view, wherein the longitudinal axis A—A of girder 1 passes through the centers of portions 21 and 22 of the superstructure. Since it is preferred for the girder axis A—A to pass through the center of all superstructure portions during the concrete pouring stages, girder 1 is moved laterally on the rollers of the main supports to center it at each stage when the superstructure section is curved. Since the transverse axes of the main supports are perpendicular to the longitudinal axis of the bridge, the main supports are rotatable about their vertical axis so that they adopt themselves to the required positions in a curve.

FIG. 23 shows a position of the main girder analogous to that of FIG. 11, the girder having been transversely, moved and the main supports swivelled about their axes to assume the required positions. The movement along a curved path will be simplified and facilitated if concrete forms or casings 9 and 10 are transversely movably mounted on the main girder so that they may be suitably adjusted laterally when they are empty. In the pouring position, the casings are rotatable about their axes.

A specific embodiment of a main support is illustrated in FIGS. 24 to 27. Illustrated support 2 is a roller block having a lower bearing part 28 supported on load-carrying webs of bridge superstructure 31. To level roller block part 28 in case the load-carrying bridge web has a superelevation, blocks 29 may be used to support part 28 on the web. Roller block part 28 may have anchoring means 30 for anchoring the block to the superstructure and thus to secure it against tensile stresses or tipping over.

Roller block part 28 carries holder 27 for two hydraulic cylinders 26 and the holder is movable in guide tracks extending tranversely to the extension of the superstructure, means being provided for fixing the holder in any transverse position. The holder transmits forces downwardly, i.e. normal thrust, and upwardly, i.e. tensile stresses. A piston rod extends upwardly from the piston in each cylinder 26 and carries roller carrier 24 rotatable about axis 52. The roller carriers bear the load of main girder 1, which rests on its rollers, and they are linked at their respective ends to guide yokes 25 to produce a parallelogram guidance best shown in FIGS. 26 and 27. This enables the roller carriers always to remain parallel to each other and to the longitudinal axis of the main girder.

The inclination of roller carriers 24 is adjustable and an adjacent thereof is required when the axis of main girder 1 is not parallel to superstructure of the bridge.

Guide track 32 is mounted on the main girder and runs along its axis, suspension plates 35 being rotatably affixed to guide yokes 25 and engaging the guide track to suspend roller block 2 from the girder and to enable the roller block to be moved along the girder in the longitudinal direction thereof. Furthermore, cable 33 is connected to girder 1 and cooperates with cable feed device 34 to move roller block support 2 along track 32. Roller carriers 24 have transverse guides 37 capable of bearing longitudinal forces and enabling roller sets 36 to be transversely moved by distance *e* (see FIG. 27) under full load. Main girder 1 may be moved in the direction of its longitudinal axis on the rollers. In this manner, the girder may be moved on roller block 2 longitudinally and transversely, about a vertical axis and up and down while under full load, i.e. with the concrete form filled with concrete. Furthermore, the roller block may be relieved of any load and freely suspended from the girder for movement therealong.

Figure 29:
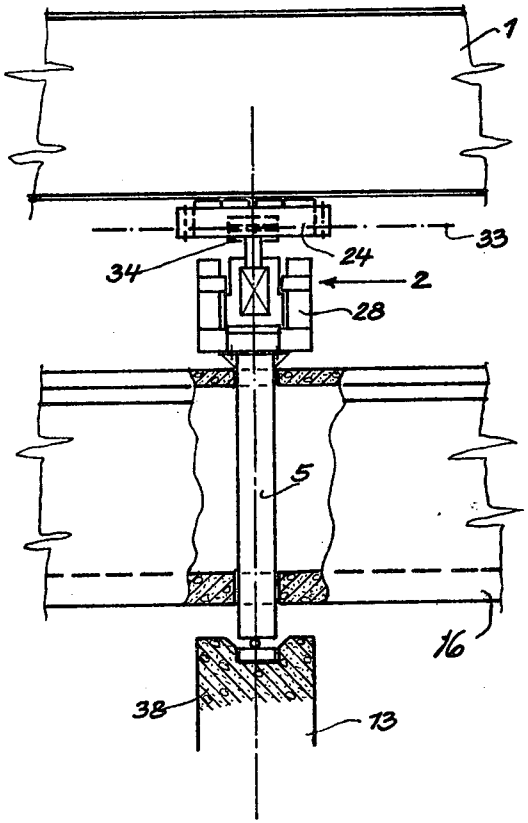
FIGS. 28 and 29 are respectively front and side elevational views of a front main support with a support structure.
Figure 28:
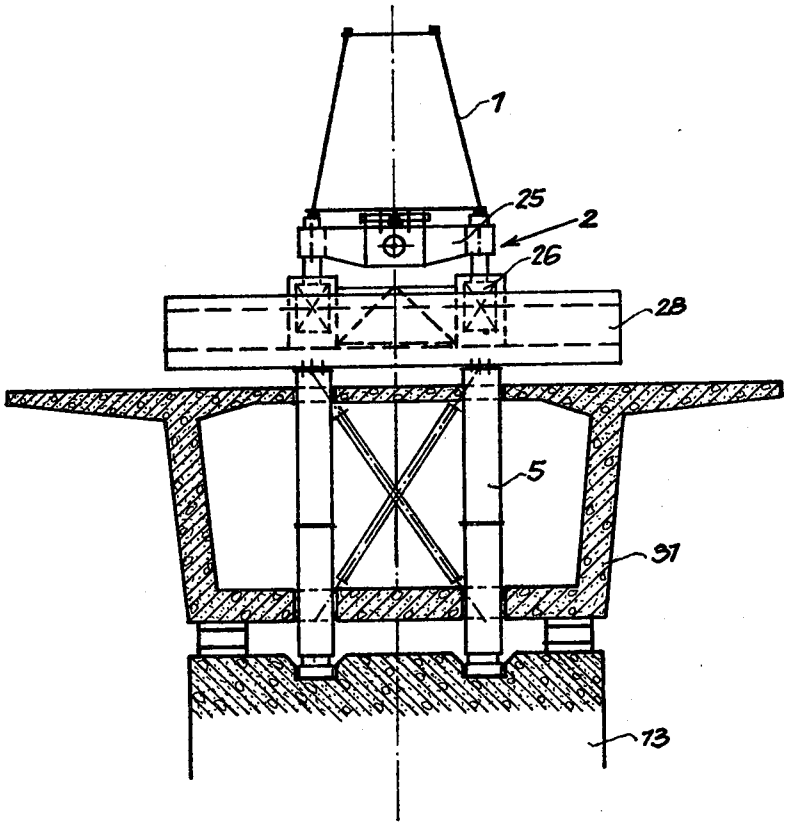

FIGS. 28 and 29 illustrates the mounting of support structure 5 on pier 13, as generally described hereinabove in connection with FIGS. 11 to 15, and its connection to roller block 2. If desired, the support structure may be anchored to the pier to resist stresses. As shown, support structure 5 consists of two braced tubular supports which are affixed to support part 28 of the roller block at one end thereof, the connection between the tubular supports and part 28 resisting thrust and stress forces. The other ends of the tubular supports rest in recesses 38 in pier 13. Support structure 5 remains in the illustrated position until center portion 16 of the superstructure section has been completed, thus assuring a connection between the girder and pier 13.

Figure 31:
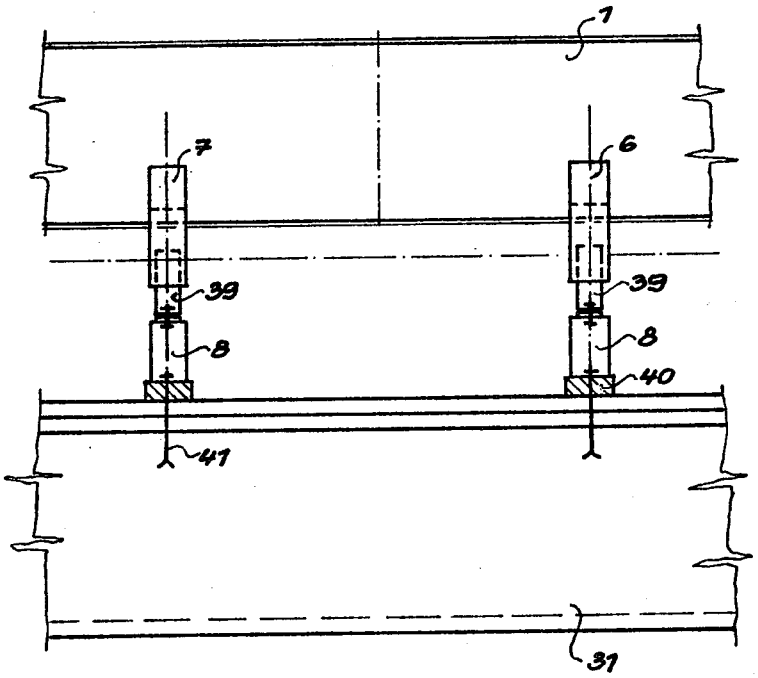
FIGS. 30 and 31 are respectively front and side elevational views of auxiliary supports used in the apparatus.
Figure 30:
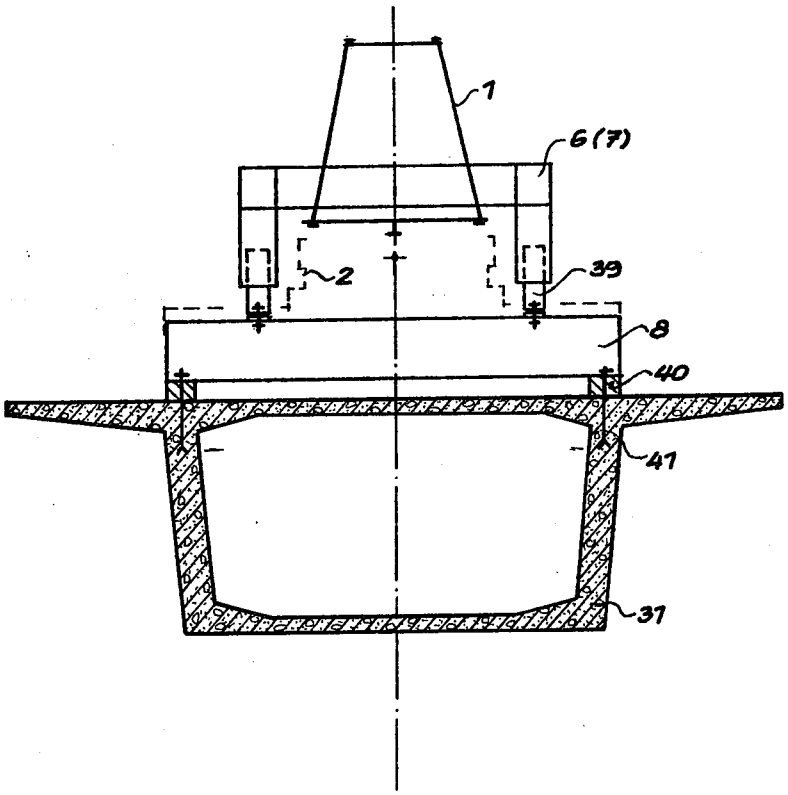

FIGS. 30 and 31 show a specific embodiment of auxiliary supports 6, 7. As illustrated, these supports comprise a carrier yoke affixed to main girder 1 and two retractable parts 39 mounted in the legs of the yoke. These parts may be hydraulic jacks. Crossbeam 8 is placed on block 40 on a load-carrying web of the superstructure and the retractable parts of the auxiliary supports are vertically aligned with the crossbeam so that parts 39 will be supported thereon when lowered. It desired, blocks 40 may be anchored to the web of the superstructure, as shown at 41, and the lowered parts 39 of the supports may be anchored to blocks 40. The carrier yoke of the auxiliary supports is so dimensioned and constructed that the main supports (whose outer dimensions are sketched at 2 in FIG. 30) may be freely moved passed the auxiliary supports along the girder, the auxiliary supports bridging over the main supports.

Figure 33:
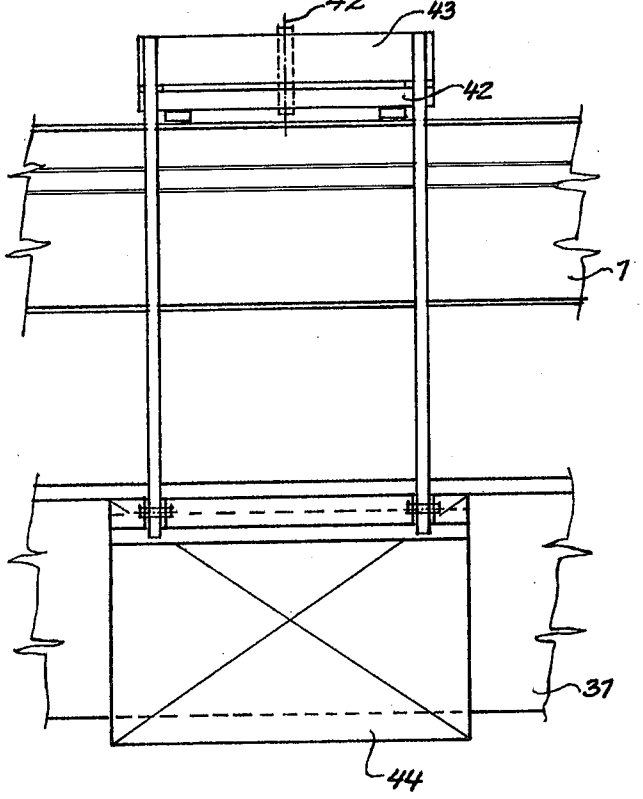
FIGS. 32 and 33 are respectively front and side elevational views of concrete forms or casings used in the apparatus.
Figure 32:
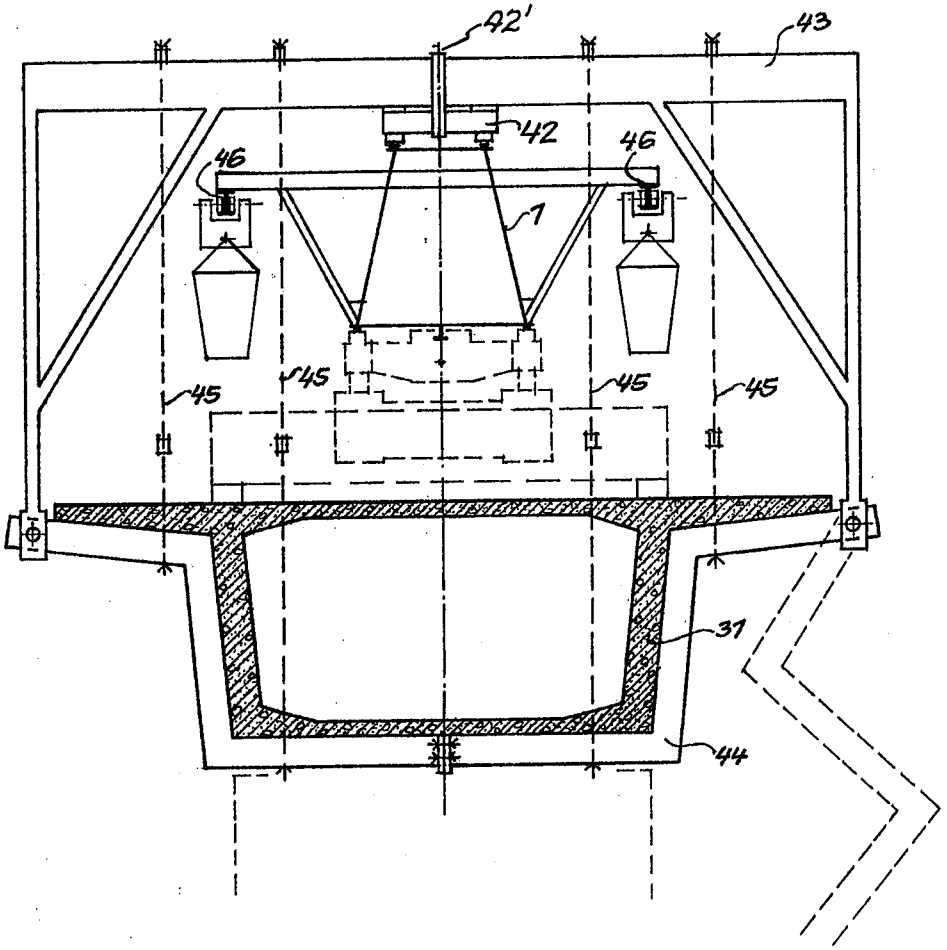

FIGS. 32 and 33 show a specific embodiment of a concrete form or casing construction for use with the apparatus of this invention. The illustrated casing construction is movable along the main girder in the direction of its longitudinal axis on undercarriage 42 running on top of the girder. Suspension frame 43 is mounted on undercarriage 42 by pivot 42' for pivoting about a vertical axis and may also be moved on the undercarriage in a direction transverse to the longitudinal extension of girder 1. This rotatable and laterally movable suspension frame carries casing 44 for pouring concrete to form superstructure portion 31. The casing is removably affixed to frame 43 and, as shown in broken lines in FIG. 32, it may be pivoted downwardly sufficiently to enable the entire assembly to pass a pier when the apparatus is advanced. Suspension rods 45 extend from the upper beam of frame 43 to transmit the loads of the concrete directly. When girder 1 is advanced, the portions of the suspension rods reaching into the superstructure portion are removed.

As shown in FIG. 32, main girder 1 may also carry guide tracks 46 along which buckets of concrete, concrete reinforcements and the like may be transported.

I claim:

1. An apparatus for the sequential production of concrete sections of a superstructure spanning a plurality of piers spaced from each other in a longitudinal direction and supporting the superstructure sections, comprising (a) an elongated main girder extending in the longitudinal direction and positionable sequentially above a respective one of the piers and the superstructure section to be supported on the pier;

(b) two concrete forms carried by the main girder for receiving and forming concrete into a respective portion of each superstructure section on either side of the pier, each of the concrete forms being movable along the main girder in the longitudinal direction to a respective side of the pier;

(c) support means for the main girder, the support means being arranged to support the main girder on previously formed concrete portions of the superstructure and comprising (1) a rigid, stationary, auxiliary support in the center of the main girder intermediate a front and rear end thereof, the auxiliary support including two retractable support elements positioned on either side of the pier when the main girder is positioned above the pier, (2) two main supports positionable rearwardly of the auxiliary support, (3) a third main support positionable frontwardly of the auxiliary support, the main supports being movable along the girder in the longitudinal direction, (4) the auxiliary support being arranged and dimensioned so that at least one of the main supports may be moved in the longitudinal direction past the auxiliary support;

(d) means on the main girder for selectively retracting respective ones of the main supports and for lowering respective ones of the main supports, the main supports being in thrust and stress force bearing connection with the main girder, selective retracting and lowering of the main supports vertically moving the main girder together with the concrete forms carried thereby and any concrete load therein while the respective main supports support the main girder on the previously formed concrete portions of the superstructure;

(e) means on the main supports enabling the supported main girder to be moved on the main supports in the longitudinal direction;

(f) means on the main girder for maintaining the main supports suspended on the main girder for movement therealong when the main supports are retracted, and (g) the retractable auxiliary support elements being selectively operative to be lowered into supporting engagement with a previously formed concrete portion of the superstructure for supporting the main girder when the concrete forms carry no concrete load.

2. The apparatus of claim 1, wherein the thrust and stress force bearing main supports are roller blocks carrying rollers supporting the main girder for movement in the longitudinal direction.

3. The apparatus of claim 1, further comprising means mounting at least one of the main supports for rotation about a vertical axis with respect to the main girder.

4. The apparatus of claim 1, wherein at least one of the main supports comprises a parallelogram guide system including two pairs of links, the main girder carries a guide track running in the longitudinal direction, one pair of the links of the main support being suspended from the guide track for movement therealong, and the other pair of the links supporting the load of the main girder, the links of the other pair being pivotal about a vertical axis and being connected with the means for vertically moving the main girder.

5. The apparatus of claim 4, wherein the one main support includes a support part arranged to rest on a previously completed portion of the superstructure, transverse guide means on the support part extending in a direction transverse to the longitudinal direction, and means movable along the guide means for holding the parallelogram guide system.

6. The apparatus of claim 4, wherein the links of the other pair carry sets of rollers supporting the load of the main girder, the sets of rollers being movable transversely on the links.

7. The apparatus of claim 1, further comprising crossbeams operatively associated with the auxiliary support elements positionable on a previously formed portion of the superstructure for cooperation with the lowered auxiliary support elements.

* * * * *

UNITED STATES PATENT OFFICE

CERTIFICATE OF CORRECTION

PATENT NO. : 4,087,220

DATED : May 2, 1978

INVENTOR(S) : Kurt Koss

It is certified that error appears in the above-identified patent and that said Letters Patent are hereby corrected as shown below:

At [30], change "1975" to --1974-- and change "/75" to --/74--

Signed and Sealed this

*Twenty-ninth* Day of *August 1978*

[SEAL]

*Attest:*

RUTH C. MASON
*Attesting Officer*

DONALD W. BANNER
*Commissioner of Patents and Trademarks*